US005688058A

United States Patent [19]

Honegger

[11] Patent Number: 5,688,058

[45] Date of Patent: Nov. 18, 1997

[54] PROCESS AND APPARATUS FOR THE TYPOGRAPHICAL LABELING OF TWO SIDES OF PRINTED PRODUCTS

[75] Inventor: Werner Honegger, Bäch, Switzerland

[73] Assignee: Ferag AG, Hinwil, Switzerland

[21] Appl. No.: 548,875

[22] Filed: Oct. 26, 1995

[30] Foreign Application Priority Data

Oct. 27, 1994 [CH] Switzerland ..... 03214/94

[51] Int. Cl.[6] ..... B41J 3/54

[52] U.S. Cl. ..... 400/82; 101/408; 101/230; 271/268

[58] Field of Search ..... 101/35, 36, 37, 101/40, 40.1, 43, 44, 223, 229, 230, 408; 400/82, 188; 198/408; 118/46, 209, 314, 315, 316, 324, 503; 271/82, 204, 205, 206, 267, 268, 277; 346/134; 347/104; 427/209, 210, 211, 466, 468, 471

[56] References Cited

U.S. PATENT DOCUMENTS

| | | | |
|---|---|---|---|
| 1,746,492 | 2/1930 | Newton et al. | 101/408 |
| 2,007,886 | 7/1935 | Stussi | 271/268 |
| 2,593,180 | 4/1952 | Pritchard | 101/230 |
| 3,012,500 | 12/1961 | Koch | 271/204 |
| 4,381,056 | 4/1983 | Eberle | 271/204 |
| 4,434,714 | 3/1984 | Combeau | 101/40.1 |
| 4,538,161 | 8/1985 | Reist | 346/140 R |
| 4,930,414 | 6/1990 | Wirz | 101/230 |
| 5,052,667 | 10/1991 | Hänsch | 270/55 |
| 5,324,014 | 6/1994 | Honegger et al. | 270/55 |
| 5,356,128 | 10/1994 | Eberle et al. | 271/204 |
| 5,388,820 | 2/1995 | Eberle et al. | 271/277 |
| 5,395,151 | 3/1995 | Eberle | 271/277 |
| 5,398,920 | 3/1995 | Leu | 271/3.1 |
| 5,425,837 | 6/1995 | Hansch | 271/204 |

*Primary Examiner*—David A. Wiecking

*Attorney, Agent, or Firm*—Bell, Seltzer, Park & Gibson, P.A.

[57] ABSTRACT

The printed products, overlapping one another in an imbricated manner, are moved, by means of the conveying device, past the first printing station in a conveying direction, where the first outer side of the printed products is provided with typographical labeling in the exposed border region. Before the printed products are guided past the second printing station, the border region of the second outer side of the printed products is exposed; for example by turning over the printed products. Printed products are then provided with typographical labeling in the border region by means of the second printing station.

11 Claims, 3 Drawing Sheets

Fig.4
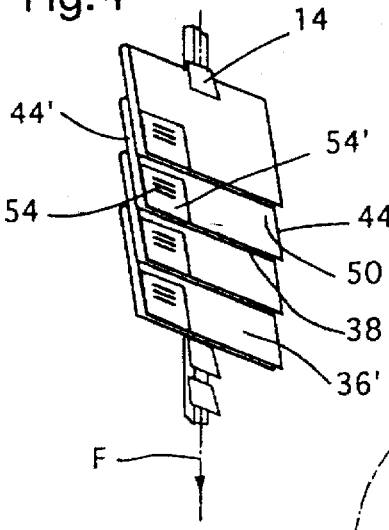
Fig.5
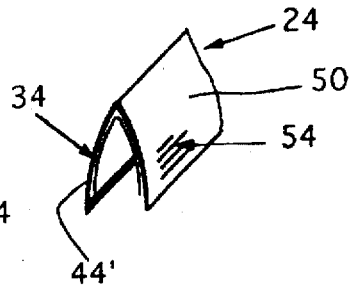
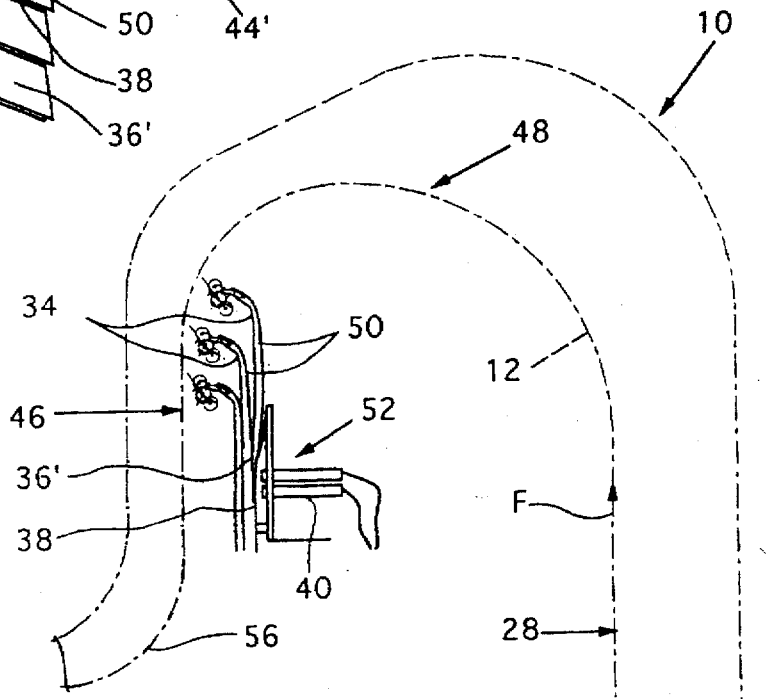
Fig.3
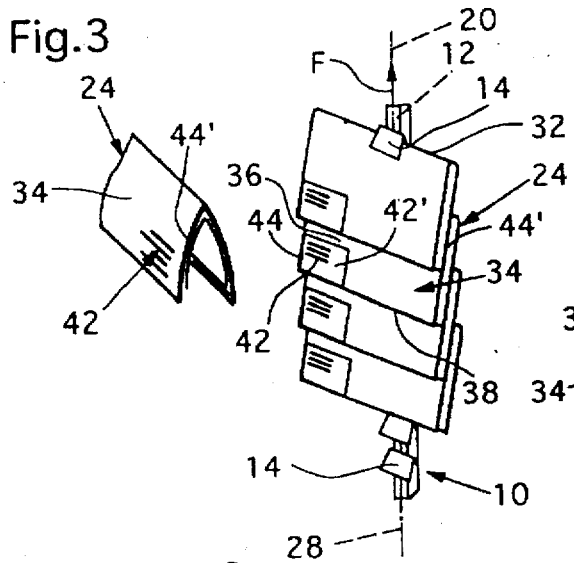
Fig.2
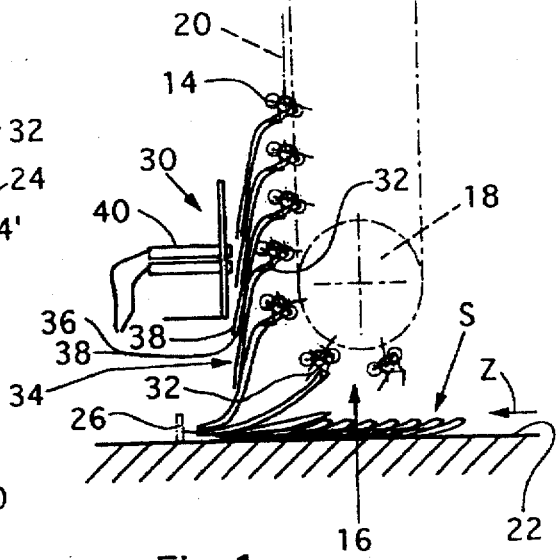
Fig.1

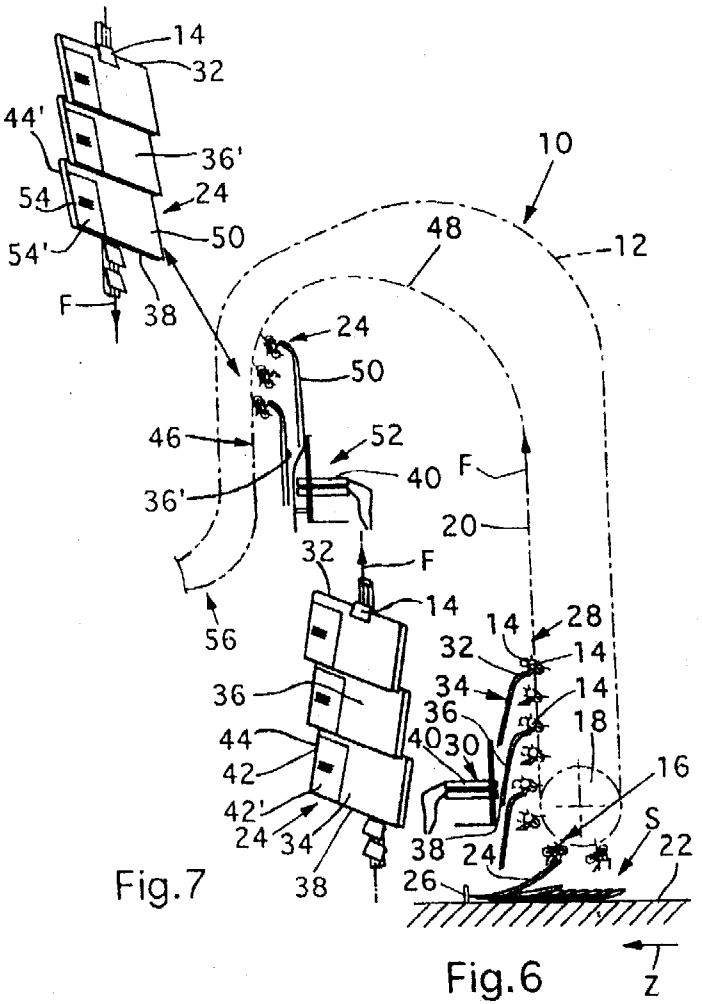
Fig.6
Fig.7
Fig.8
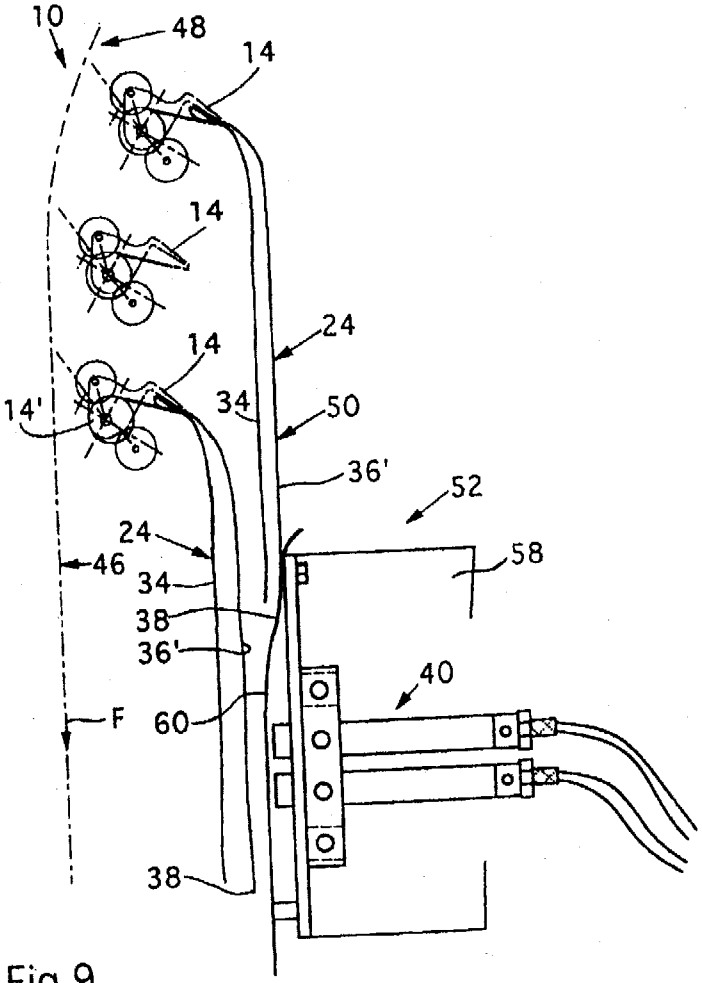
Fig.9

PROCESS AND APPARATUS FOR THE TYPOGRAPHICAL LABELING OF TWO SIDES OF PRINTED PRODUCTS

FIELD OF THE INVENTION

The present invention relates to a process and an apparatus for the typographical labeling of printed products, such as newspapers, periodicals, supplements and the like.

BACKGROUND OF THE INVENTION

A prior art process and apparatus is set forth in EP-A-0 096 228 and the corresponding U.S. Pat. No. 4,538,161. The prior art apparatus includes a printing station with an inkjet printer and a conveying device for conveying products running over and past the printer in the horizontal direction. The conveying device comprises clamps arranged at regular intervals one behind the other on a drawing member and have their clamp mouth directed rearwards, as seen in the conveying direction. Each clamp retains a printed product at a border running at right angles with respect to the conveying direction, and draws it over and past the printing station. The trailing border region, which is located opposite the above-mentioned border, rests on a rest of said printing station. The bottom outer side, facing the printing station, of each printed product is overlapped in an imbricated manner by the preceding printing product, with the result that in each case only the trailing border section is exposed. The printed products are then labeled typographically by means of the inkier printer in said border section.

The prior art process and apparatus are very well suited to label the printed products typographically in the border section of one outer side. However, they are neither provided nor are they suitable to be able to label printed products typographically on the other outer side.

SUMMARY OF THE INVENTION

An object of the present invention is thus to provide a process and apparatus which make it possible to label printed products typographically optionally on either of the two outer sides or on both outer sides.

This object is achieved by a process and by an apparatus of typographically labeling of printed products having first and second outer sides comprising the steps of individually clamping the printed product utilizing clamps of a conveying device for the typographical labeling of printed products having two outer sides; transporting the printed products in a conveying direction with imbricated overlapping to a first printing station, further transporting the printed products past the first printing station and printing typographical labeling on the printed products on said first outer side, transporting the printed products past a second printing station and typographically labeling printed products on said second outer side wherein, before at least one of said first outer side and said second outer side is labeled typographically, a region of said respective first or second outer side is exposed, said region having been previously covered over by another printed product.

The invention provides two printing stations for typographically labeling one of the two outer sides of printed products. The inventive operation of exposing a region of at least one outer side makes it possible to label printed products typographically at locations which were previously covered due to the imbricated overlapping of the printed products. Furthermore, the exposure operation makes it possible for the printing station to have access to regions which were previously covered by the conveying device.

BRIEF DESCRIPTION OF THE DRAWINGS

The invention will now be described in more detail with reference to two embodiments represented in the drawing, in which, purely schematically:

FIG. 1 shows a conveying device with spaced-apart clamps which, with the printed products overlapping in an imbricated manner, guide said printed products, in the vertical direction from bottom to top, past a first printing station and, after running through a curve, guide said printed products, in the turned-over state from top to bottom past a second printing station;

FIG. 2 shows a perspective representation of printed products which have been labeled typographically, by the first printing station, on one outer side;

FIG. 3 shows a perspective representation of a printed product which has been labeled typographically, by the first printing station, at a location other than that in FIG. 2;

FIG. 4 shows a perspective representation of printed products which have been labeled typographically, by the second printing station, on the other outer side from that in FIG. 2 and 3;

FIG. 5 shows a perspective representation of the printed product shown in FIG. 3, which printed product has been labeled typographically, by the second printing station, on the other outer side as well;

FIG. 6 shows the device shown in FIG. 1, only every second clamp of the conveying device being occupied by a printed product;

FIG. 7 shows, in the same representation as in FIG. 2, printed products which have been labeled typographically by means of the first printing station according to FIG. 6;

FIG. 8 shows, in the same representation as in FIG. 4, printed products which have been labeled typographically by means of the second printing station according to FIG. 6;

FIG. 9 shows, on an enlarged scale with respect to FIG. 6, the second printing station and a part of the conveying device;

DETAILED DESCRIPTION OF THE DRAWINGS

Figure 10:
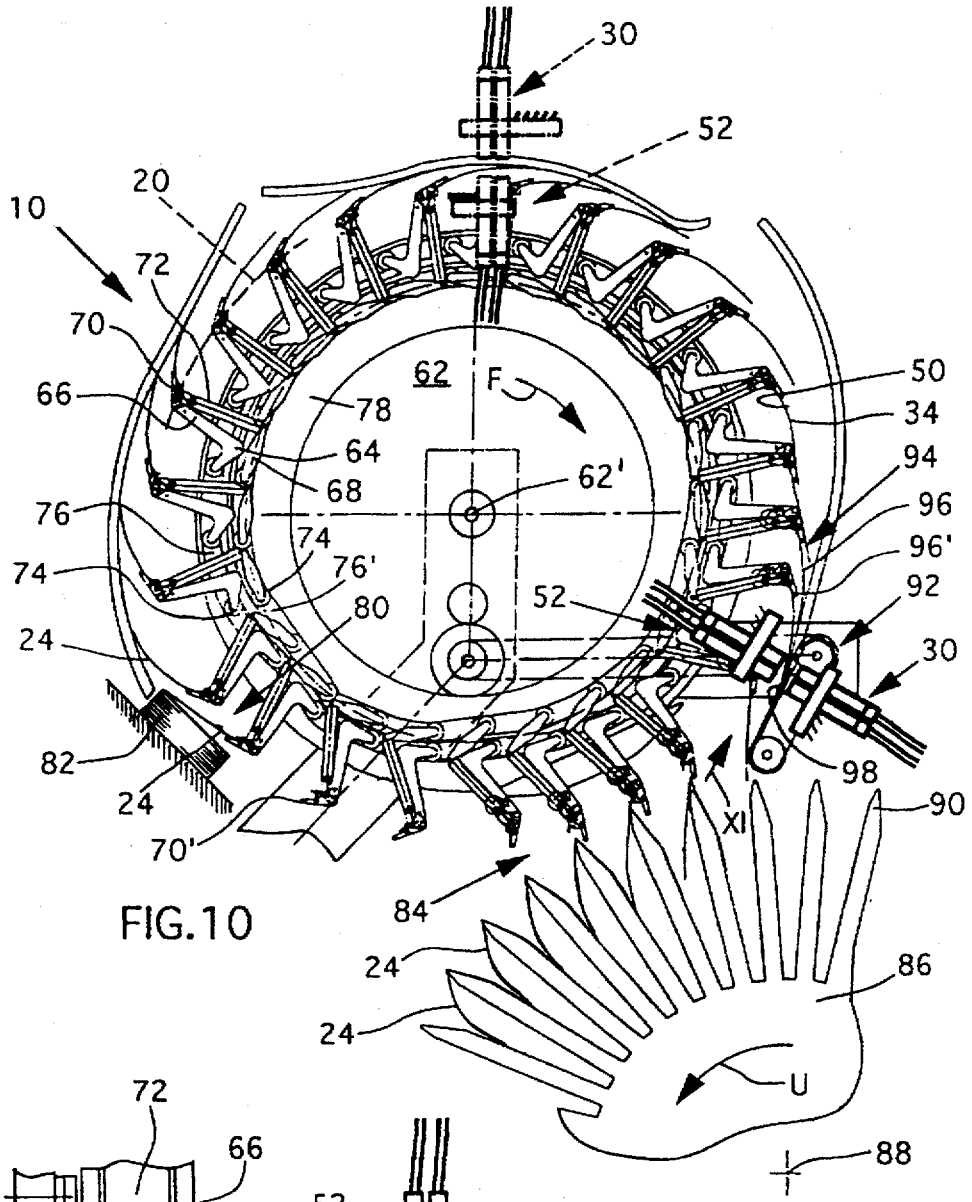
FIG. 10 shows a conveying device which is designed in the manner of the wheel and has clamps which are arranged one behind the other and whose mutual spacing can be changed in order to guide the printed products past two printing stations with reduced overlapping and then to transfer them to a drum-like processing station.

The apparatus shown in FIG. 1 comprises a conveying device 10 with controllable clamps 14 which are arranged at regular intervals one behind the other on a drawing member 12 which is indicated by chain-dotted lines and is driven continuously in a conveying direction F. The continuous drawing member 12, for example a chain, is known in general and, as can be seen in FIG. 2 and 4, is guided in a channel and, in a receiving region 16, is deflected around a deflection wheel 18 for driving. Conveying devices 10 of this type are known, for example, in EP-A-0 600 183, EP-A-0557 679, EP-A-0 557 680 and CH-A-644 816, and the corresponding U.S. Pat. Nos. 5,395,151, 5,356,128, 5,388,820 and 4,381,056, all of which are incorporated herein by reference. The guided drawing member 12 thus determines a movement path 20 for the clamps 14.

Arranged beneath the deflection wheel 18 is a feed conveyor 22 which is formed as a belt conveyor and is intended for conveying printed products 24 in the feed direction Z against a stop 26, which printed products 24 are arranged in an imbricated formation S in which, as seen in the feed direction Z, each printed product 24 rests on the following printed product 24. Each clamp 14 running around the deflection wheel 18 seizes in each case the uppermost printed product 24 resting against the stop 16 and raised by means of a sucker arrangement, as is disclosed in EP-A-0 551 601 and the corresponding U.S. Pat. No. 5,398,920 which are incorporated herein by reference, and transports the printed product in a suspended manner, in a first section 28, which runs in the vertical direction and adjoins the deflection wheel 18, of the movement path 20, from bottom to top past a first printing station 30. The printed products 24, preferably being multiple-sheet folded newspapers, periodicals, parts thereof or supplements, are retained by the clamps 14 at a border 32 running at right angles with respect to the conveying direction F and are transported with imbricated overlapping. As a result, the first outer side 34 of each printed product 24, i.e., the outer side facing the first printing station 30 and being directed away from the drawing member 12, include only a border region 36 which is freely accessible, said border region extending along the edge 38 which is located opposite the border 32 and follows said border 32 in the first section 28.

The first printing station 30 exhibits an inkjet printer 40, as is disclosed in EP-A-0 096 228 and in the corresponding U.S. Pat. No. 4,538,161 which are incorporated herein by reference, and it is intended for the typographical labeling of all the printed products 24, or of specific printed products 24, in the border region 36 of the first outer side 34. The typographical labeling 42, see FIG. 2, is, for example, the address of the recipient, a code for further processing, a note or the like. The typographical labeling 42 is provided in a labeling zone 42' which borders one side edge 44 of the printed products 24 and extends only over a section of the border region 36. Of course, the labeling zone 42' may also adjoin the other side edge 44', as is shown in FIG. 3, be located in the center of the border region 36 or extend over the entire border region 36.

Downstream of the first section 28, the conveying device 10 exhibits a second section 46 which likewise runs in a vertical direction and belongs to the movement path 20, the conveying direction F running from top to bottom in the said second section 46. The first section 28 and the second section 46 are connected to one another via a curved section 48 which runs approximately in the form of an upside-down U. Since the printed products 24 are transported in the suspended state by means of the clamps 14, they are turned over when they run through the curved section 48, with the result that, in the second section 46, the first outer side 34 now faces the drawing member 12 and the other, second outer side 50 faces a second printing station 52. In relation to the movement path 20, said printing station 52 is arranged on the same side as the first printing station 30 and is of essentially the same design. Due to the imbricated overlapping of the turned-over printed products 24, in each case a border region 36', extending along the now leading edge 38, of the second outer side 50 is now exposed in each case, it now being possible for further typographical labeling 54 to be provided in said border region 36' by the second printing station 52, as is shown in FIG. The corresponding further labeling zone 54' may, in turn, adjoin one of the two side edges 44, 44', or extend over the entire border region 36' or in the central region thereof. It goes without saying that the typographical labeling 54 may be of a different content or of the same content as the typographical labeling 42.

FIG. 5 shows the printed product 24 shown in FIG. 3, with the typographical labeling 54 provided on the second outer side 50. Said typographical labeling 54 is located opposite the typographical labeling 42. The apparatus shown in FIG. 1 can thus be used to label the printed products 24 typographically, either on one or both of the outer sides 34, 50. Of course, it is also possible for single printed products 24 of the imbricated formation not to be labeled typographically, or for some printed products 24 to be labeled typographically only on one of the outer sides 34, 50 and others to be labeled typographically on both outer sides 34, 50.

The second section 46 is adjoined, seen in the conveying direction F, by a transfer section 56 in which the printed products 24 are transferred, by the clamps 14 being opened, to a further-processing station, for example a drum-like device for collecting, collating or inserting printed products. Such further-processing devices are known, for example, from EP-A-0550 828 and EP-A-0 341 425 and the corresponding U.S. Pat. Nos. 5,324,014 and 5,052,667 which are incorporated herein by reference.

The apparatus shown in FIG. 6 corresponds to the apparatus shown in FIG. 1 and is thus not described in any more detail; the same reference symbols designate the same objects. The single difference consists in the fact that, in the receiving region 16, now only every second clamp 14 is provided with a printed product 24. This results in the overlapping of the printed products 24, as seen in the conveying direction F, being reduced, in comparison with FIG. 1, with printed products 24 of the same size. In any case, the width of the border regions 36, 36' is increased, as seen in the conveying direction F, in comparison with FIG. 1; with the same distance between the clamps 14, the width of the border regions 36, 36', in the case of the apparatus according to FIG. 6, corresponds to twice the distance between the clamps 14, and said width is only equal to the distance between the clamps 14 in the case of the apparatus according to FIG. 1.

As can be seen, in particular, from FIG. 7 and 8, the increase in the border regions 36, 36' results in the labeling zones 42', 54' having a greater extent, at right angles with respect to the edge 38, and thus in it being possible to provide the typographical labeling 42, 54 at locations which, in the case of the type of operation of the apparatus according to FIG. 1, are covered over by an adjacent printed-product 24.

The printed products 24 being retained by means of the clamps 14 in the suspended position and the passage through the curved section 48 result in all the printed products 24 being fed to the second printing station 52 in the turned-over state. The conveying device 10 is thus designed, between the first and second printing station, as an arrangement for exposing a region covered over by another printed product 24, the border region 36' of the second outer side 50.

FIG. 9 shows, on an enlarged scale with respect to FIG. 6, part of the curved section 48 and of the adjoining second section 46 of the conveying device 10, as well as the second printing station S2 arranged beside the second section 46. The printing heads of the inkjet printer 40 are fastened in a stationary manner on a framework 58, such that they can be adjusted preferably in the direction at right angles with respect to the conveying direction F. The adjustability makes it possible to provide typographical labeling in different sections of the border region 36'. Guide rails 60 are likewise arranged on the framework 58, which guide rails, arranged in front of the printing heads, run past said printing heads, up to the side thereof, in the direction counter to the conveying device 10, in order to guide the edge 38, of the printed products 24, which leads in the second section 46 and to prevent said printed products 24 from catching on the printing station 52 when they are transported past the same. It goes without saying that the first printing station 30 does not need such guide rails 60 since, there, the printed products 24 are transported past with the edge 38 trailing.

Printed products 24 guided past the second printing station 52 can be labeled typographically in the exposed border region 36' of the second outer side 50 facing said printing station 52.

The clamps 14 can be pivoted about an axis 14' running at right angles with respect to the conveying direction F; this also makes it possible to transport relatively small printed products 24 in the suspended state. If only large-format printed products 24 are to be processed, it would be conceivable to provide non-pivotable clamps 14 whose mouth is arranged at least approximately at right angles with respect to the conveying direction F. It can also be appreciated that, by controlled pivoting of the clamps 14, regions of the outer sides 34, 50 of the printed products 24 can be exposed for typographical labeling or exposed regions 36, 36' can be enlarged. It is thus, for example, possible, in the case of the apparatus shown in FIG. 1 and 6, to pivot the clamp 14, directly after completion of the typographical labeling, by means of the first printing station 30, of the printed product 24 retained by said clamp 14, out of the rearwardly oriented position, as seen in the conveying direction F, in the clockwise direction into a position which is oriented forwards or approximately at right angles with respect to the conveying direction. This means that the overlapping of the next-following printed product 24 is reduced. The pivoting of the clamps 14 takes place by suitable control means, for example a guide element.

That embodiment of the apparatus according to the invention which is shown in FIG. 10 exhibits a wheel-like conveying device 10, as is described and shown in detail in the earlier CH Patent Application No. 02 667/94-2 incorporated herein by reference. The wheel-like conveying device 10 may also be designed as is disclosed in EP-A-0 606 550 and the corresponding U.S. Pat. No. 5,425,837 which are incorporated herein by reference.

Radial extension arms 64 project, with a fixed circumferential spacing, from a carrier wheel 62 which is continuously driven in rotation about its axis of rotation 62' in the conveying direction F. Pivotably mounted on each of these extension arms 64 is a carrying arm 66, designed as an angle lever, and double-armed control lever 68. Mounted pivotably at the free end of the approximately radially running lever arm of each carrying arm 66 is a clamp 70, which is likewise connected, via a connecting rod 72, to one lever arm of the relevant control lever 68. Freely rotatably mounted in respect of the other lever arm of the carrying arm 66 and control lever 68 is in each case the one control roller 74, each of these being guided in a closed control groove 76, 76' running around the carrier wheel 62. The control grooves 76, 76' are made in a stationary control ring 78.

The pivot position of the carrying arm 66 relative to the extension arms 64 is determined by means of the control groove 76 and the pivot position of the clamps 70 is determined by means of the control groove 76'. By pivoting a carrying arm 66, the distance between adjacent clamps 70 can be changed.

The clamps 70 are moved, with their open mouth 70' directed forwards in the conveying direction F, to a receiving region 80, where they are provided with a printed product 24, if appropriate a card or a folded sheet, raised from a supply stack 82.

The control grooves 76, 76' are designed such that, when the printed products 24 are seized, the speed of the clamps 70 is reduced by the carrying arms 66 being pivoted in the anticlockwise direction, i.e. counter to the direction of rotation F; this is due to the short distance between the two clamps 70 located at the supply stack 82. In a region following the receiving region 80, the carrying arms 66 are then pivoted forwards again in the clockwise direction, which increases the distance from the following clamps 70 and thus reduces the overlapping of the corresponding printed products 24 or, in the case of small printed products 24, even eliminates said overlapping.

Offset by approximately 270°, in the conveying direction F, with respect to the receiving region 80 is a transfer region 84, in which the printed products 24 are transferred to a further-processing station 86. The further-processing station 86 shown is a drum-like device with saddle-like rests 90 which are arranged around a common horizontal axis of rotation 88, are driven in the direction of circulation U and onto which the folded printed products 24, which have been opened by means of an opening device 92, are deposited in a straddling manner. In this arrangement, the clamps 70 are rotated in the anticlockwise direction by the control groove 76', and the distance between the clamps 70 is adapted, by the control groove 76, to the distance between the rests 90, with the result that the mouth 70' of the relevant clamps 70 is aligned in each case with a rest 90.

Figure 11:
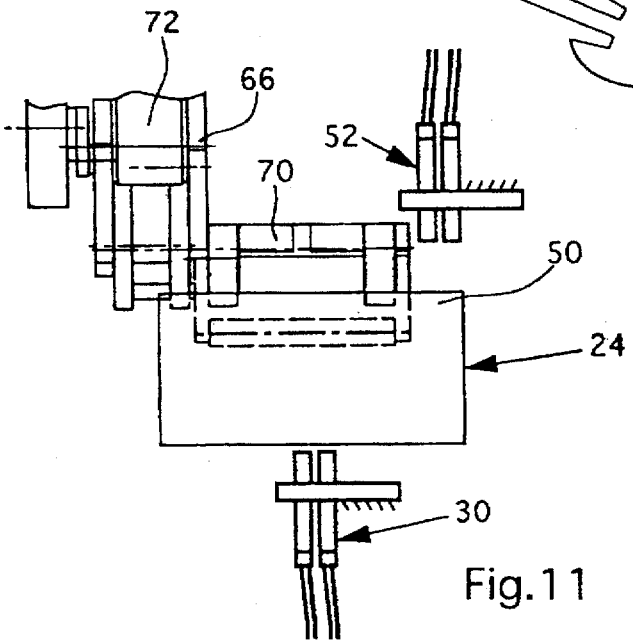
FIG. 11 shows, on an enlarged scale, part of the device shown in FIG. 10, as seen in the direction of the arrow XI of FIG. 10.

Arranged in a stationary manner laterally adjacent to the opening device 92 is a first printing station 30 and, in relation to the movement path 20, on the other, radially inner side, is a second printing station 52, see also FIG. 11. The printing stations 30, 52 are intended for typographically labeling printed products 24 on their radially outer first outer side 34 and their radially inner second outer side 50, respectively. In this arrangement, the typographical labeling takes place optionally on one of the two outer sides 34, 50 or simultaneously on both outer sides 34 and 50.

As can be seen clearly with reference to the three clamps 70 shown directly upstream of the printing stations 30, 52, in a section 94, which is arranged upstream of the printing stations 30, 52 and belongs to the approximately circular movement path 20 of the clamps 14, the mutual spacing of said clamps is reduced by the carrying arms 66 being pivoted in the anticlockwise direction, and the imbricated overlapping of the corresponding printed products 24 is thus increased. Since, however, at the same time the carrying arm 66 of the printed products 24 moved past the printing station 30, 52 is pivoted in the clockwise direction, the region 96, which is overlapped by the following printed product 24 and belongs to the first outer side 34, is reduced or eliminated, as a result of which large-surface-area typographical labeling of the first outer side 34 can be carried out by means of the first printing station 30.

The above-mentioned simultaneous pivoting of the carrying arm 66 in opposite directions also exposes a region 96' of the radially inner second outer side 50 of the printed products 24, with the result that said second outer side 50 may also be labeled typographically over a large surface area.

In the example shown, the deceleration and acceleration of the clamps 70 serves both for exposing regions 96, 96' of the printed products 24 and for introducing the radially outer part, exhibiting the first outer side 34, of the folded printed products into opening cams 98 of the opening device 92, as is also described in the earlier CH Patent Application No. 02 667/94-2 incorporated herein by reference.

As is indicated by chain-dotted lines in FIG. 10, the first and second printing stations 30, 52 may also be arranged between the receiving region 80 and the opening device 92 and the transfer region 84, the movement path 20 of the clamps 70 running through between the mutually opposite printing stations 30, 52, as seen in the radial direction.

It is also conceivable to transport the printed-products by means of a conveying device according to FIG. 1, the products being suspended on the pivotable clamps, along an approximately rectilinear and horizontal movement-path section and to arrange the two printing stations beneath said movement-path section and offset in the conveying direction. The printed products are then moved beyond one printing station, with their free border region trailing and resting on supporting rails, and are moved beyond the other printing station with their free border region leading and resting on supporting belts which are driven at a greater speed than the clamp speed. Border regions of the printed products are exposed by virtue of this type of transportation and support.

That which is claimed is:

1. A process for typographically labeling printed products having first and second outer sides comprising the steps of individually clamping the printed products utilizing clamps of a conveying device, transporting the printed products in a conveying direction with imbricated overlapping along a path of travel, while printing typographical labeling on said first outer side at a first printing station located along the path of travel, and while printing typographical labeling on said second outer side at a second printing station located along the path of travel, and including the further step of exposing a region of at least one of the first and second outer sides which previously had been covered over by another printed product, with the exposing step occurring prior to the one outer side being typographically labeled.

2. The process as claimed in claim 1, wherein the first and second printing stations are spaced apart from one another along the path of travel in the conveying direction, and wherein the exposing step includes turning over the printed products to expose a region of the second outer side which is to be labeled typographically by means of the second printing station.

3. The process as claimed in claim 2, wherein the transporting step includes retaining the printed products in a suspended manner by the clamps, transporting the products past one of the first and second printing stations with the conveying direction directed essentially from bottom to top and transporting the products past the other of the first and second printing stations with the conveying direction directed essentially from top to bottom.

4. The process as claimed in claim 1, wherein the exposing step includes reducing the overlapping of the printed products by increasing the distance between successive clamps.

5. The process as claimed in claim 4, wherein the step of printing typographical labeling on said first outer side and the step of printing typographical labeling on said second outer side occur simultaneously by means of said first and second printing stations being arranged on opposite sides of the path of travel.

6. An apparatus for the typographical labeling of printed products, comprising a conveying device comprising a plurality of clamps which are serially arranged and which are driven in circulation in a conveying direction along a continuous path of travel, with the printed products being retained individually by the clamps of the conveying device and conveyed with imbricated overlapping, a first printing station located along the path of travel for typographically labeling a first of two outer sides of the printed products, a second printing station located along the path of travel for typographically labeling a second of the two outer sides of printed products, said apparatus also comprising an arrangement provided upstream of at least one of the first and second printing stations for exposing a region of the printed products which is covered over by another printed product, said region being located in the outer side which is to be labeled typographically in the one of the printing stations.

7. The apparatus as claimed in claim 6, wherein, in relation to the path of travel, the printing stations are arranged on the same side and one behind the other in the conveying direction, and wherein the conveying device is configured for retaining the printed products by means of its clamps at a border running transversely with respect to the conveying direction, the printed products being fed to one of the printing stations with an edge located opposite said border trailing in the conveying direction, and being fed to the other of the printing stations with said edge leading in the conveying direction.

8. The apparatus as claimed in claim 7, wherein the clamps are configured for retaining the printed products in a suspended manner, wherein one of the printing stations is arranged at a first section of the path of travel in which section the conveying direction runs essentially from bottom to top, and the other of the printing stations is arranged at a second section of the path of travel in which section the conveying direction runs essentially from top to bottom.

9. The apparatus as claimed in claim 6, wherein said arrangement for exposing a region of the printed products includes a control device for changing the distance between successive clamps.

10. The apparatus as claimed in claim 9, wherein the first and second printing stations are positioned at least approximately opposite one another, and the path of travel runs therebetween.

11. The apparatus as claimed in claim 9, wherein the control device includes means for pivoting the clamps about an axis running transversely with respect to the conveying direction.

* * * * *